US011241856B2

(12) United States Patent
Vilanova Alzamora

(10) Patent No.: US 11,241,856 B2
(45) Date of Patent: Feb. 8, 2022

(54) MULTI-HEAD MULTIFORMAT BOX FORMING MACHINE

(71) Applicant: TAVIL IND, S.A.U., Girona (ES)

(72) Inventor: Manuel Vilanova Alzamora, Girona (ES)

(73) Assignee: TAVIL IND, S.A.U., Girona (ES)

( * ) Notice: Subject to any disclaimer, the term of this patent is extended or adjusted under 35 U.S.C. 154(b) by 235 days.

(21) Appl. No.: 16/301,274

(22) PCT Filed: May 17, 2017

(86) PCT No.: PCT/ES2017/070326
§ 371 (c)(1),
(2) Date: Nov. 13, 2018

(87) PCT Pub. No.: WO2017/198887
PCT Pub. Date: Nov. 23, 2017

(65) Prior Publication Data

US 2020/0316896 A1 Oct. 8, 2020

(30) Foreign Application Priority Data

May 18, 2016 (EP) ..... 16382217

(51) Int. Cl.

| | |
|---|---|
| ***B31B 50/26*** | (2017.01) |
| ***B31B 50/44*** | (2017.01) |
| ***B31B 50/00*** | (2017.01) |
| *B31B 50/62* | (2017.01) |
| *B31B 100/00* | (2017.01) |
| *B31B 110/35* | (2017.01) |
| *B31B 120/10* | (2017.01) |

(52) U.S. Cl.
CPC ..... *B31B 50/44* (2017.08); *B31B 50/006* (2017.08); *B31B 50/62* (2017.08); *B31B 2100/0024* (2017.08); *B31B 2110/35* (2017.08); *B31B 2120/102* (2017.08)

(58) Field of Classification Search
CPC ..... B31B 50/00; B31B 50/44
See application file for complete search history.

(56) References Cited

U.S. PATENT DOCUMENTS

| | | | | | |
|---|---|---|---|---|---|
| 2,015,202 | A * | 9/1935 | Stokes | B31B 70/00 | 493/59 |
| 4,003,299 | A * | 1/1977 | Sternheimer | B31B 50/00 | 493/59 |
| 5,024,641 | A * | 6/1991 | Boisseau | B31B 50/00 | 493/143 |
| 5,382,155 | A * | 1/1995 | Boix Jaen | B31B 50/46 | 425/577 |
| 2014/0155238 | A1* | 6/2014 | Thompson | B31B 50/00 | 493/114 |
| 2015/0141227 | A1* | 5/2015 | Nemi | B31B 13/00 | 493/84 |
| 2020/0114611 | A1* | 4/2020 | Marsh | B31B 50/005 | |

FOREIGN PATENT DOCUMENTS

| | | | | |
|---|---|---|---|---|
| DE | 20019140 U1 | 4/2001 | | |
| EP | 0761424 A1 | 3/1997 | | |
| EP | 2450180 A1 * | 5/2012 | B31B 50/00 | |
| EP | 2450180 A1 | 5/2012 | | |
| WO | 2010048680 A1 | 5/2010 | | |

* cited by examiner

*Primary Examiner* — Eyamindae C Jallow
(74) *Attorney, Agent, or Firm* — Hayes Soloway PC

(57) ABSTRACT

The present invention relates to a multi-head multiformat box forming machine, using die-cut cardboard sheets, having three differentiated areas: a feeding area, a shaping area and a discharge area, wherein the multi-head multiformat box forming machine enables the shaping of different cardboard box formats using the same machine and at greater speed than simple multiformat box forming machines, saving down times and costs associated thereto.

15 Claims, 8 Drawing Sheets

MULTI-HEAD MULTIFORMAT BOX FORMING MACHINE

OBJECT OF THE INVENTION

The present invention relates to a multi-head multiformat box forming machine, using die-cut cardboard sheets, having three differentiated areas: a feeding area, a shaping area and a discharge area.

The object of the invention is a multi-head multiformat box forming machine that makes it possible to produce different cardboard box formats using the same machine and at greater speed than simple multiformat box forming machines, saving down times and costs associated thereto.

BACKGROUND OF THE INVENTION

Cardboard boxes represent a widely used medium for the storage, transport and distribution of all types of products. Production and distribution companies use cardboard boxes to package their products in packing units for the subsequent storage, transport and distribution thereof.

At present, the packaging or wrapping process is integrated in the production process itself, due to which production industries have their own means for creating boxes in accordance with their needs in terms of formats and amounts. In order to cover all packaging needs, industries have a large amount of cardboard box formats, stored in the form of die-cut cardboard sheets in order to optimise their storage space. In accordance with the characteristics, size and number of products to be packaged the appropriate box format is selected and the corresponding die-cut sheets are disposed in the forming machine for shaping thereof in the production and/or packaging line itself.

In general, these box forming machines have a feeder that dispenses the die-cut sheets unit by unit to the shaping area, where a series of automatisms fold the peripheral flap of the sheet to obtain the side walls of the box and gluing thereof.

Market needs require increasingly short and varied productions, due to which the packaging thereof implies constant changes in the format of the boxes to be used. The change in box format requires the modification of parameters, tools for folding and forming of the machine, with the ensuing loss of time involved.

European patent EP2450180B1 discloses a multiformat box forming machine that comprises at least one die-cut cardboard sheet storage unit, a feeder for dispensing die-cut cardboard sheets unit by unit, means for guiding and positioning the die-cut cardboard sheet, means for supplying an adhesive substance on the die-cut cardboard sheet, a shaping unit that comprises at least one vertically displaceable inner mould and outer die, and means for discharging the formed box, wherein the mould and the die of the shaping unit are divided into four segments, respectively, which enable the horizontal displacement and positioning thereof at the points that coincide with the lower corners of the box, having envisaged that each of the mould-die segment assemblies will move solidly joined together to maintain the tolerances between the mould and the die; wherein the shaping unit comprises actuation means for the vertical and alternate displacement of the four segments that form the inner mould.

When the needs of the formed cardboard boxes of a packaging line increase significantly, the immediate solution would be to dispose multiple heads or shaping units in parallel in order to multiply the production of formed boxes, thereby satisfying the needs of the high-speed packaging lines.

However, this solution is not feasible because the discharging means of European patent EP2450180B1 are perpendicular to the feeder, such that all the formed boxes must cross all the heads up to the first one, which would represent slowing down the box forming process, as it would not be possible to begin a new forming cycle until all the boxes are formed. That is, the machine must pause to evacuate all the formed boxes, such that multiplying the heads would not imply duplicating box production capacity.

The present invention resolves all the aforementioned drawbacks by means of a multi-head multiformat box forming machine wherein the production of boxes per minute increases proportionally with respect to a single-head multiformat box forming machine.

DESCRIPTION OF THE INVENTION

The present invention relates to a multiple-head multiformat box forming machine, using die-cut cardboard sheets, which has three differentiated areas: a feeding area, a shaping area and a discharge area, in the same manner as the multiformat box forming machine of patent EP 2450180B1 included herein as a reference.

The multi-head multiformat box forming machine of the present invention makes it possible to form different cardboard box formats using the same machine and at greater speed than simple multiformat box forming machines, saving down times and costs associated thereto.

The multi-head multiformat box forming machine comprises, at least, one die-cut cardboard sheet storage unit, two or more feeders, wherein each one of said feeders dispenses die-cut cardboard sheets unit by unit, means for guiding and positioning the die-cut cardboard sheet, means for supplying an adhesive substance on the die-cut cardboard sheet, two or more shaping units, each of which having at least one vertically displaceable inner mould and an exterior die, and means for discharging the formed box.

In order for the machine to adapt to the different box formats, the mould and the die of each shaping unit are divided into four segments, respectively, which enable the horizontal displacement and positioning thereof in the points that coincide with the lower corners of each box, having envisaged that each of the sets of mould-die segments of each of the shaping units will move solidly joined together to maintain the tolerances between the mould and the die.

In order to facilitate the positioning and centering of the die-cut cardboard sheets in the shaping unit, both the storage unit and the means for guiding and positioning the sheets comprise a mechanism for controlling the width of the base of the storage unit, as well as the distance between lateral guides of the means for guiding and positioning the sheets.

Once the inner mould has inlaid the cardboard sheet inside the die, lateral blades, each of which is articulated to the die segments, are actuated for folding the inner flaps of the box. The actuation of said lateral blades may be pneumatic, hydraulic or electric, preferably pneumatic. These actuation means transmit a rotational movement to the lateral blades that will fold the inner flaps inwards.

Once the four inner flaps have been folded, the lateral flaps are also folded by means of curved plates disposed on the sides of each of the die segments. These curved plates are mounted on platforms joined to the sides of each of the die segments, wherein the platforms also comprise a press actuated by a pneumatic cylinder which reinforces the joining of the inner flaps against the lateral flaps by means of the adhesive substance previously deposited on the common contact areas.

Both the lateral folding blade and the platform that bears the lateral curved plate and press, as well as their actuation means, are mounted on each of the die segments, due to which they move solidly joined together in the format changes, to position themselves on each of the lower corners of the box.

The shaping unit comprises a box format change mechanism that comprises four arms, bearers on its lower ends of the die segments, whose arms are mounted, by their upper ends, on a first set of rails, assisted by a pair of motorised spindles for the transverse displacement thereof, whose first set of rails is mounted on a second set of rails, equally assisted by another pair of motorised spindles, for the longitudinal displacement thereof. By means of the actuation of the motorised spindles, the four mould-die segment assemblies are positioned at the points that coincide with the lower box corners.

The motorised spindles comprise a threaded shaft with two equal spiral portions in each direction, i.e. one left-hand threaded and another right-hand threaded, such that when the motor makes the spindle rotate the respective mould-die segment assemblies move in the opposite direction, moving further apart or closer together, respectively.

In order to facilitate the forming of the box inside the shaping unit, each of the mould segments comprises a suction pad on its lower end to secure the box.

The segments of the die of at least one shaping unit are displaceable with respect to the arms of said shaping unit, preferably by means of rotation or translation of said die segments with respect to the arms of the shaping unit so that, once the box is formed, the die segments can be retracted, so as to clear the box discharge path in a direction parallel to the direction in which the cardboard sheets are dispensed by the feeders, i.e. through the front of the machine.

For at least one of the shaping units disposed on the sides of the forming machine, the segments of the die of said shaping units are displaceable with respect to the arms of said shaping unit, preferably by means of rotation or translation of said segments of the die with respect to the arms of the shaping unit so that, once the box is formed, the die segments can be retracted such as to clear the box discharge path in a direction parallel or perpendicular to the direction in which the cardboard sheets are dispensed by the feeders, i.e. through the front or side of the machine, respectively, since the box formed in said shaping unit would not have to cross other shaping units.

The displaceable segments of the die are retracted by means of actuation means that can ban be pneumatic, hydraulic or electric, preferably pneumatic.

The box is formed by means of the vertical displacement of the mould in the interior of the die. To this end, the shaping unit comprises actuation means for the vertical and alternate displacement of the four segments that form the mould.

In a preferred embodiment, the actuation means of the four segments that form the inner mould comprise an electric motor and a connecting rod and crank mechanism that transforms the rotational displacement into an alternate linear displacement.

Furthermore, the four segments that form the inner mould are connected to the actuation means for vertical and alternate displacement through the four articulated vertical rotation axis arms, connected by the outer end to the upper ends of the mould rod and by the inner end on two sliders that slide over a transverse rail connected to the actuation means, in order to enable the horizontal displacement of the four segments of the inner mould and positioning thereof on the lower ends of the box.

The multi-head multiformat box forming machine comprises means for supplying the adhesive substance, which comprise at least two dispensing guns, disposed on the guiding means, in front of the entrance to each shaping unit, which deposit a strand of adhesive substance on the lateral flaps of the die-cut cardboard sheet.

The multi-head multiformat box forming machine comprises a control panel that governs and coordinates the different actuation means for the general operation of the machine and which also governs the actuation of the different motorised spindles for managing the change in box format.

BRIEF DESCRIPTION OF THE DRAWINGS

In order to complement the description being made and with the object of helping to better understand the characteristics of the invention, in accordance with a preferred embodiment thereof, said description is accompanied, as an integral part thereof, by a set of drawings where, in an illustrative and non-limiting manner, the following has been represented.

PREFERRED EMBODIMENT OF THE INVENTION

Figure 1:
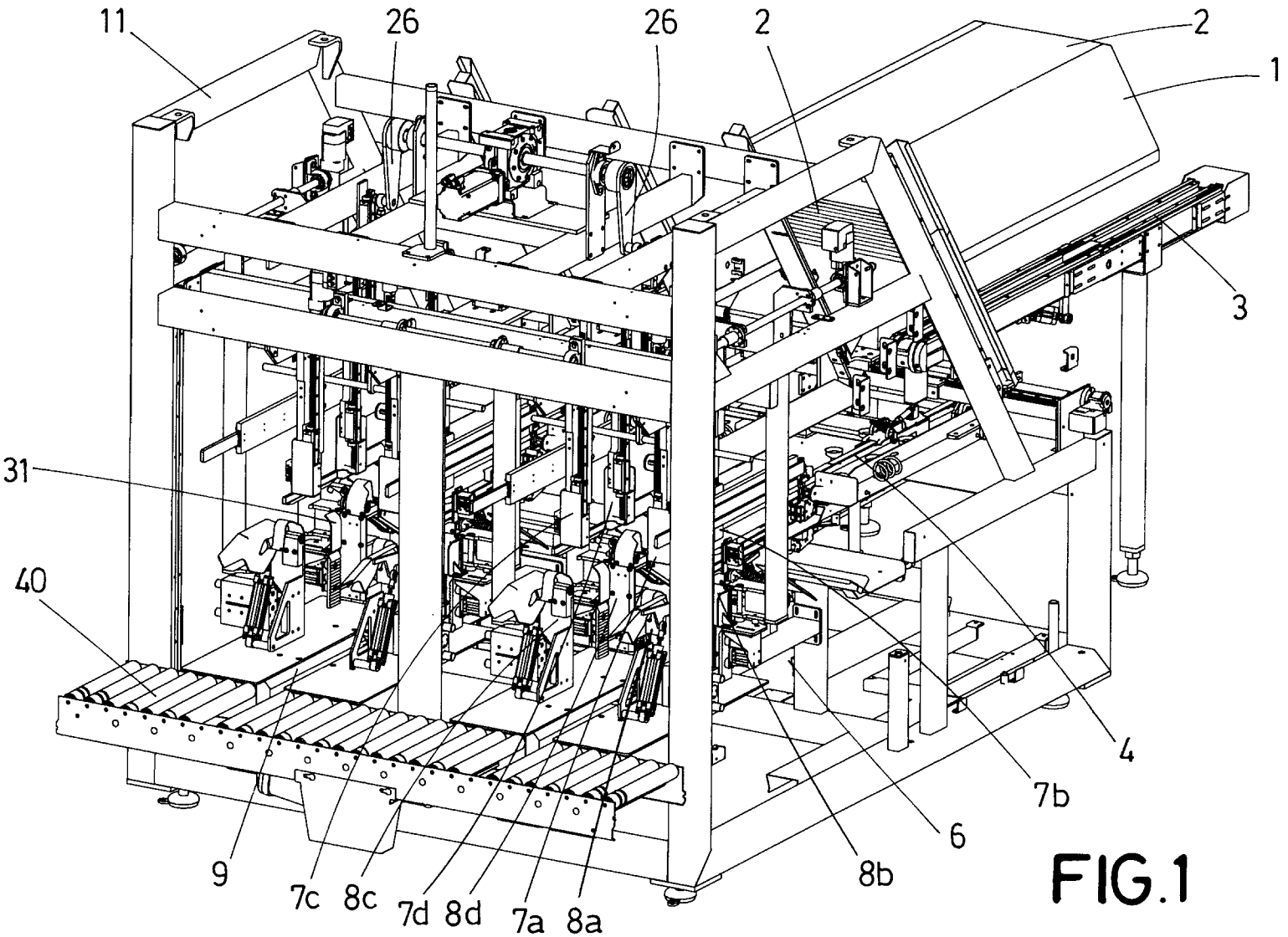
FIG. 1 shows a perspective view of the multi-head multiformat box forming machine object of the present invention, being in this case dual-head.

Following is a detailed description of the multi-head multiformat box forming machine. A dual-head multiformat box forming machine has been represented in the figures but, by extension, it is understood that the machine can also comprise three or more heads.

In light of the aforementioned figures, it can be observed how the multiformat box forming machine comprises, for each of the heads, a die-cut cardboard sheet (2) storage unit (1), a feeder (3) for dispensing the die-cut cardboard sheets (2) unit by unit, means for guiding and positioning (4) the die-cut sheet (2), a pair of guns (not shown) for supplying an adhesive substance on the die-cut cardboard sheet (2) which, once the box is formed (10), will fix its walls by overlapping of the corresponding flaps, a shaping unit (6) that comprises an inner mould divided into four segments (7*a*, 7*b*, 7*c*, 7*d*) and an exterior die also divided into four segments (8*a*, 8*b*, 8*c*, 8*d*) and an articulated arm (9) having a suction pad for discharging the formed box (10), all integrated in a general chassis (11).

The box (10) forming process begins by placing the corresponding die-cut cardboard sheets (2) in the storage units (1), wherefrom the feeders (3), consisting of an articulated arm provided with suction pads, extract a cardboard sheet (2) and deposit it on the guiding and positioning means (4), provided with a fastening pin, which positions them inside of each shaping unit (6).

Figure 4:
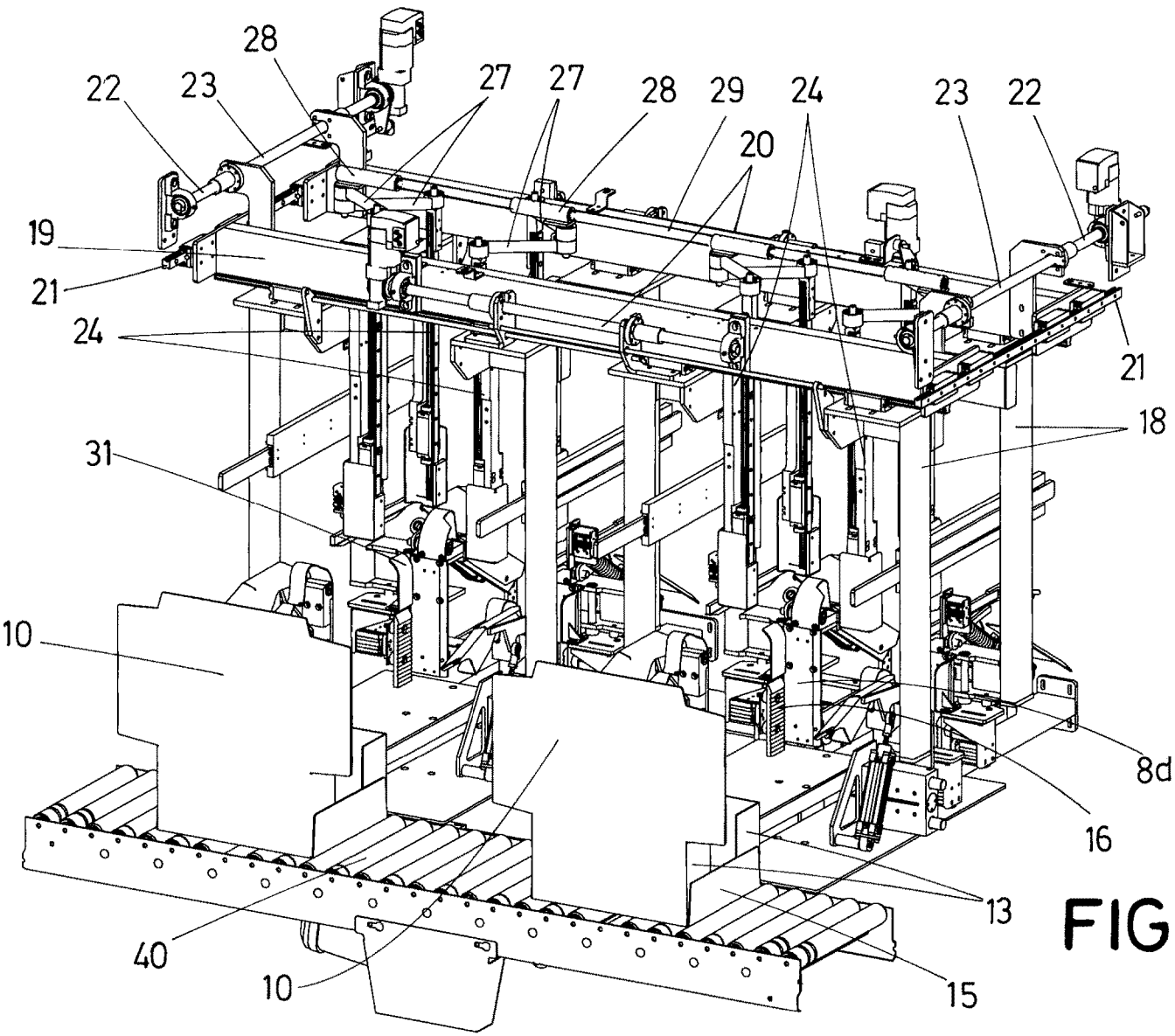
FIG. 4 shows a perspective view of the heads of the machine of the present invention with the box already formed disposed on transfer means of the boxes disposed on the front of the machine.

Once the die-cut cardboard sheet (2) has been positioned inside the shaping unit (6), the actual shaping of the box (10) is initiated, by means of the descent of the inner mould composed of its four segments (7*a*, 7*b*, 7*c*, 7*d*), which coincide with each one of the lower corners of what will be the formed box (10), as can be observed in FIG. 4. The inner mould, composed of its four segments (7*a*, 7*b*, 7*c*, 7*d*) inlays the die-cut cardboard sheet (2), inside the die composed of its four segments (8*a*, 8*b*, 8*c*, 8*d*), so that the lateral walls are raised from the body of the die-cut cardboard sheet (2).

Figure 2:
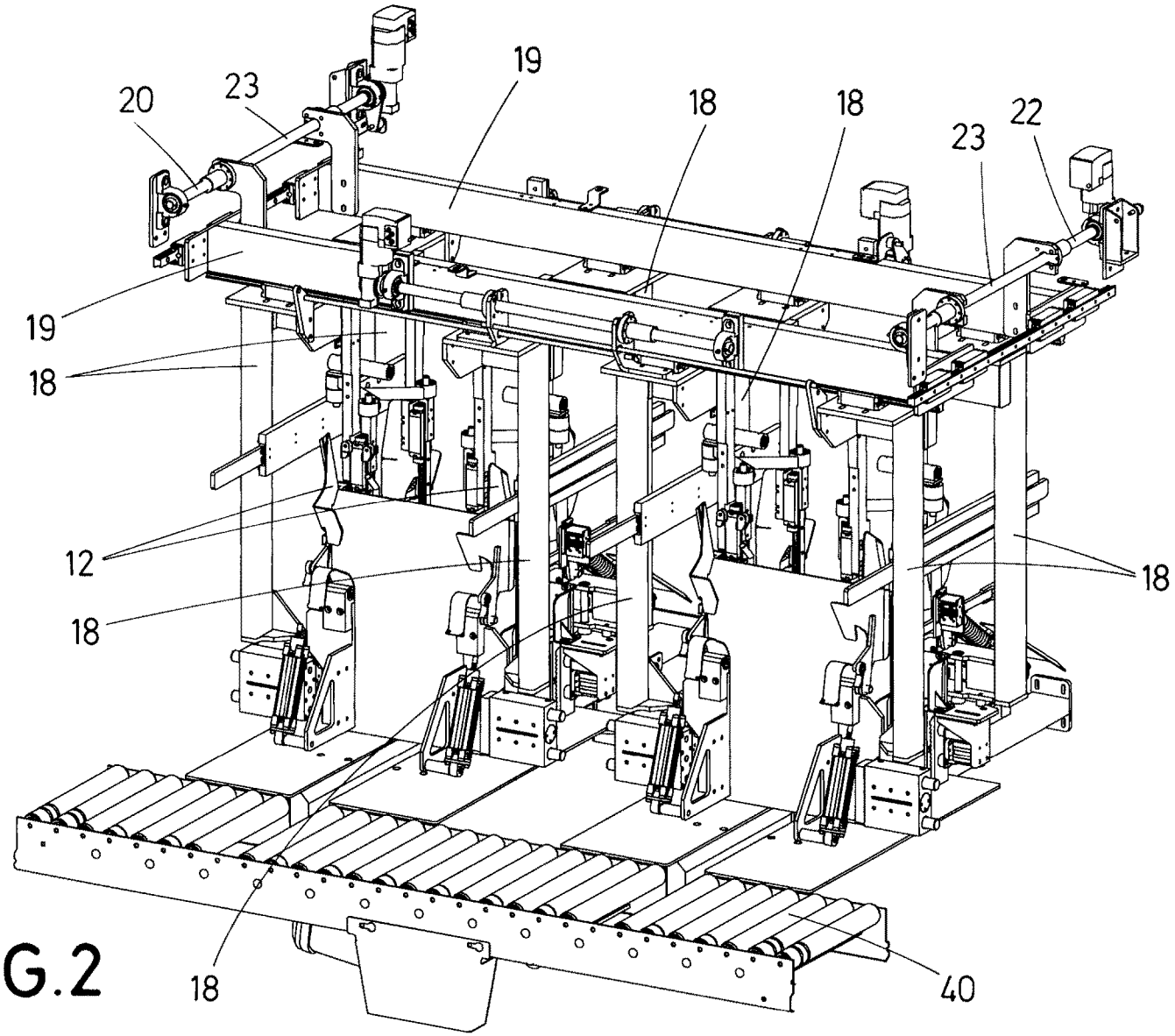
FIG. 2 shows a perspective view of the heads of the machine of the present invention with the inner mould inlaid in the die-cut cardboard sheet on the die.
Figure 3:
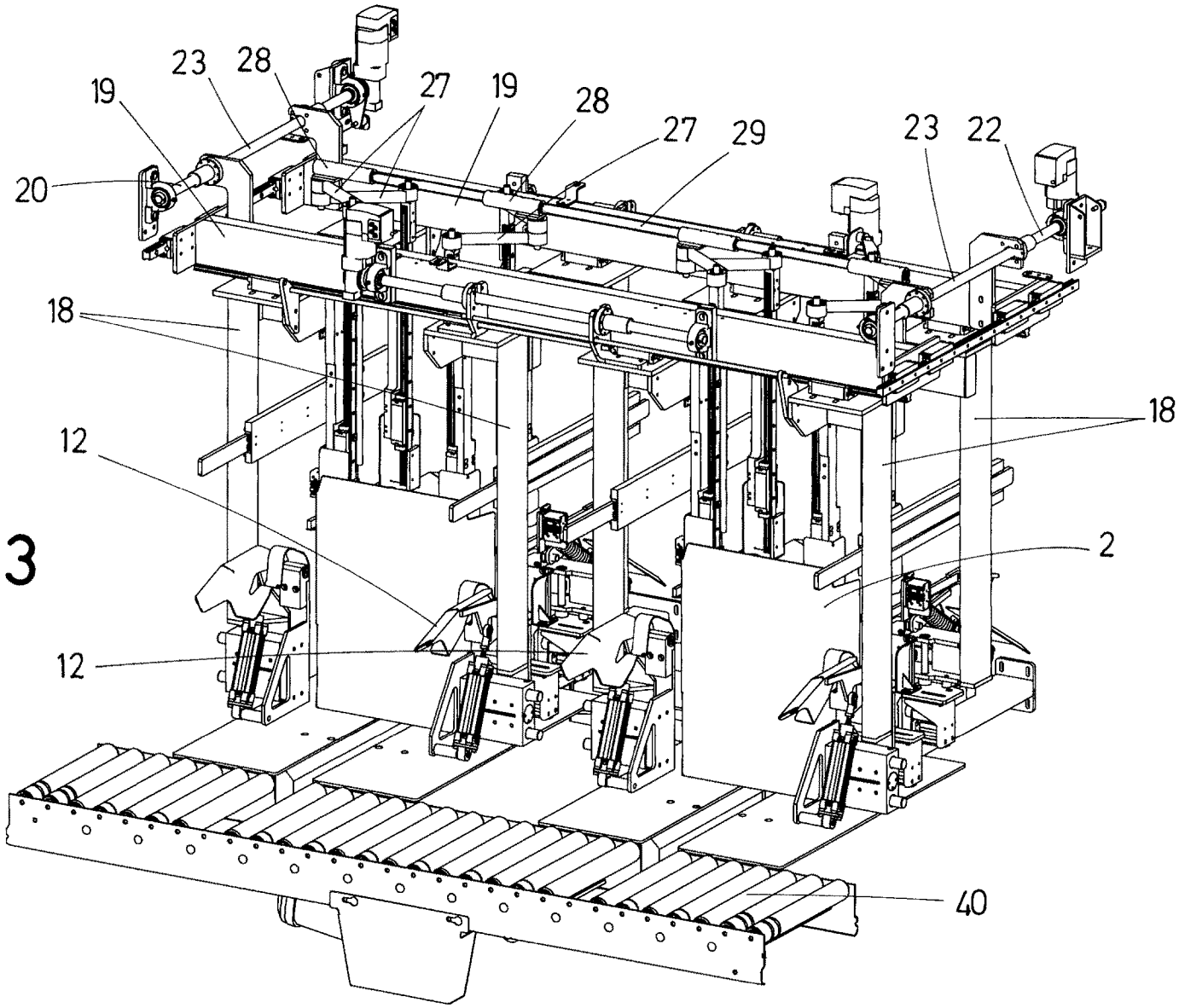
FIG. 3 shows a perspective view of the heads of the machine of the present invention with the die moving to enable the formed box to be discharged.

As can be observed in FIGS. 2 and 3, when the descent of the inner mould composed of its four segments (7*a*, 7*b*, 7*c*, 7*d*) is initiated, the lateral articulated blades (12) mounted on each one of the die segments (8*a*, 8*b*, 8*c*, 8*d*) are actuated for the folding of the inner flaps (13), which will constitute part of the lateral walls of the box (10). In the present example of embodiment, said blades (12) are articulated from their lower end on the side of the corresponding die segment (8*a*, 8*b*, 8*c*, 8*d*) and actuated by a pneumatic cylinder (14).

To finalise the shaping of the box (10), the lateral flaps (15) of the box (10) are folded and pressed by actuation of curved plates (31) disposed on the sides of each one of the die segments (8*a*, 8*b*, 8*c*, 8*d*). These curved plates (31) are mounted on folding platforms (32) joined to the sides of each one of the die segments (8*a*, 8*b*, 8*c*, 8*d*) or to the chassis (11) through one of the arms (18) of the shaping unit that will be described later on. The folding platforms (32) further comprise a press (16) actuated by a pneumatic cylinder (17), which strengthens the joining of the inner flaps (13) against the lateral flaps (15), by means of the adhesive substance previously deposited on the common contact areas.

In FIGS. 1 to 4, the die segments (8*a*, 8*b*, 8*c*, 8*d*) are displaceable with respect to the arms (18) of the shaping unit (6) so that, once the box has been formed, the die segments (8*a*, 8*b*, 8*c*, 8*d*) can be retracted so as to clear the box discharge path in a direction parallel to the direction in which the cardboard sheets are dispensed by the feeders, i.e. through the front part of the machine.

Figure 9:
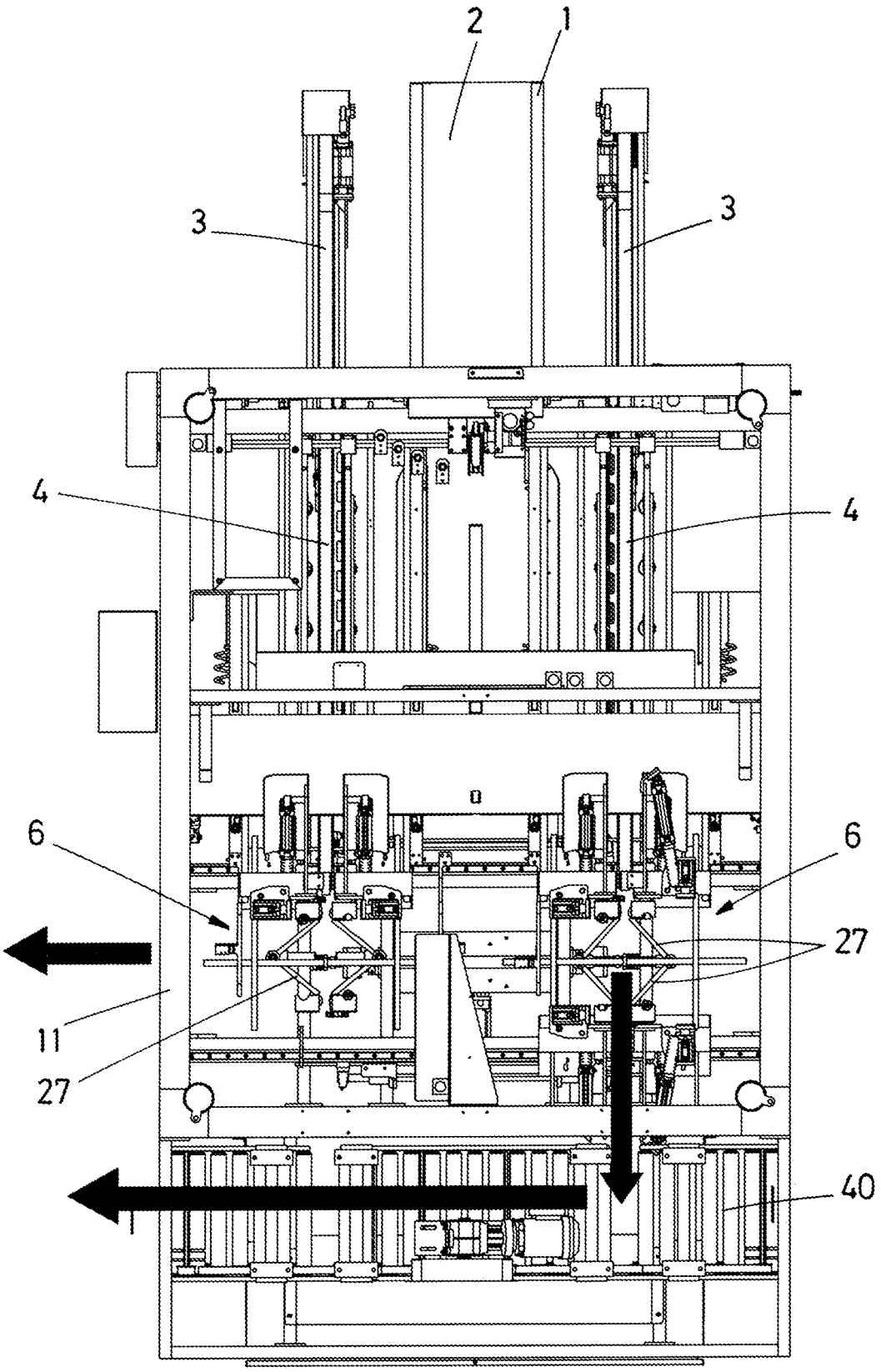
FIG. 9 shows a plan view of the multi-head multiformat box forming machine of the present invention, being in this case dual-head and wherein one of the heads is a lateral discharge head, wherein the arrows show the discharge direction of each head.

In FIG. 9, the segments (8*a*, 8*b*, 8*c*, 8*d*) of the die of one of the shaping units are displaceable with respect to the arms (18) of the shaping unit (6) so that, once the box has been formed, the die segments can be retracted to clear the box discharge path in a direction parallel to the direction in which the cardboard sheets are dispensed by the feeders, i.e. through the front part of the machine, while the segments (8*a*, 8*b*, 8*c*, 8*d*) of the die of the other shaping unit are displaceable with respect to the arms (18) of the shaping unit (6) so that, once the box is formed, the die segments can be retracted to clear the box discharge path in a direction perpendicular to the direction in which the cardboard sheets are dispensed by the feeders, i.e. through the lateral part of the machine.

The displaceable die segments are retracted by means of actuation means that may be pneumatic, hydraulic or electric, preferably pneumatic.

Figure 5:
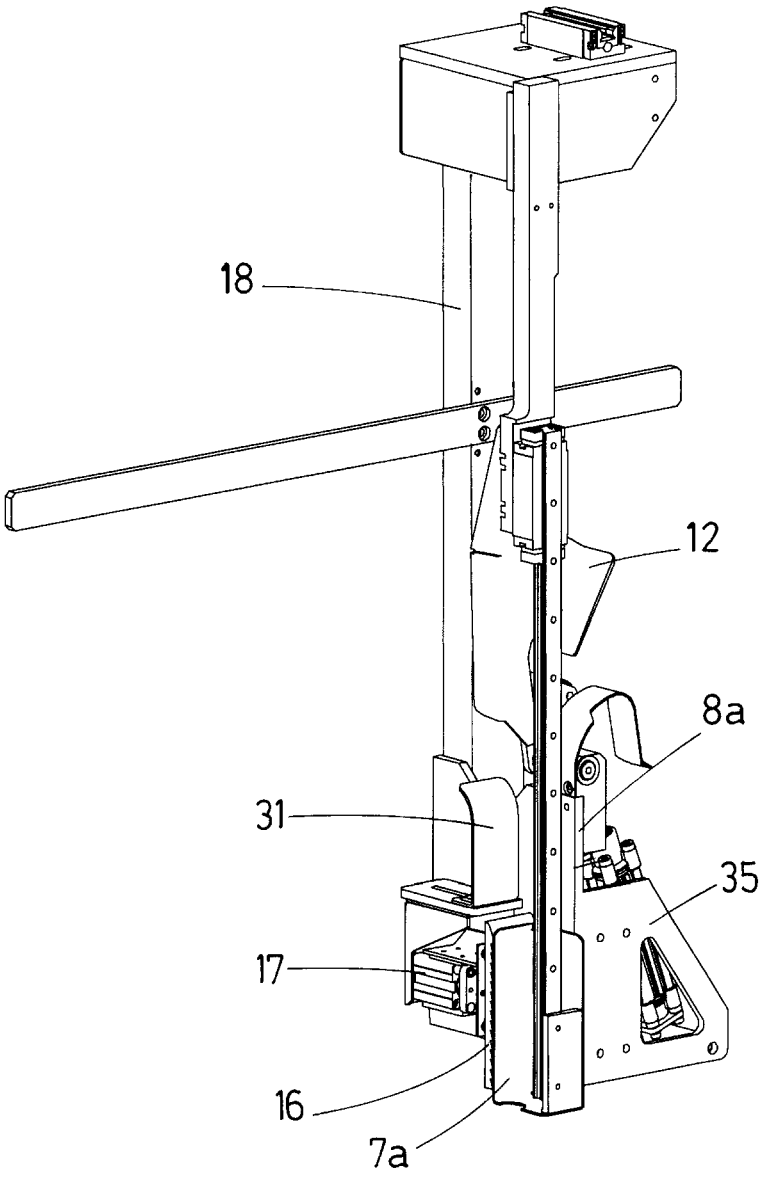
FIG. 5 shows a perspective view of a detail of the mould-die segment assembly for a first example of embodiment, in a closed position, wherein the confluence of the mould, die and press can be observed on the corner of the box.
Figure 6:
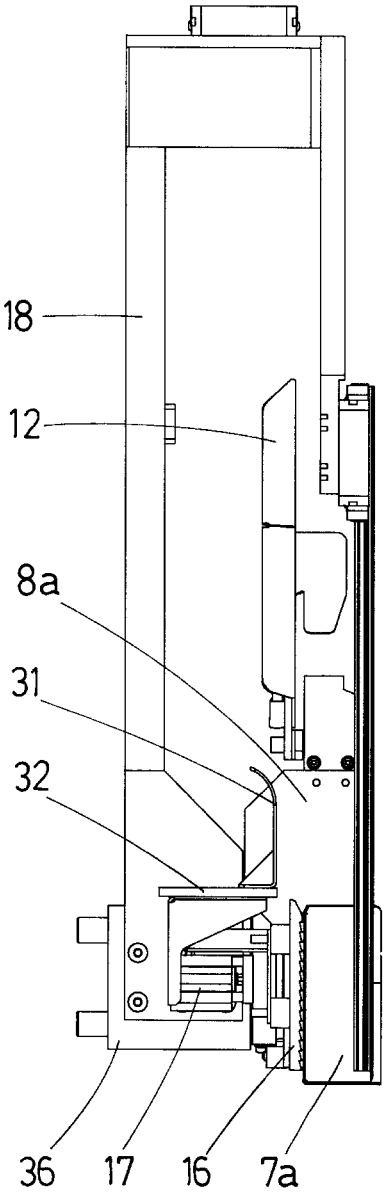
FIG. 6 shows a lateral view of FIG. 5.
Figure 7:
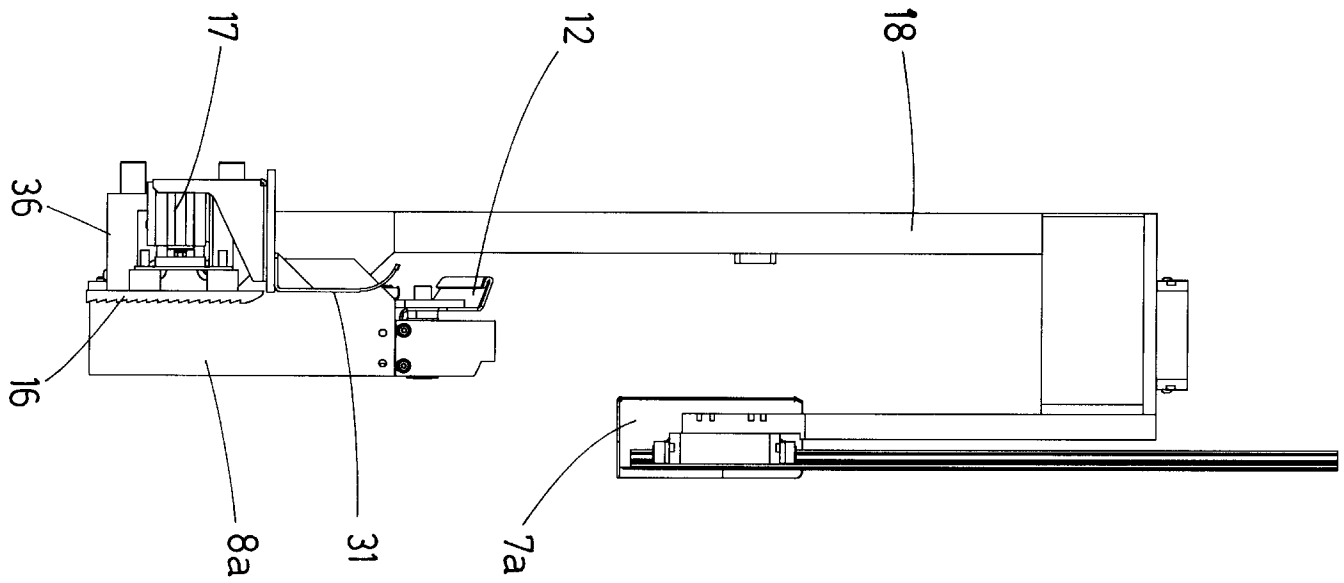
FIG. 7 shows a perspective view of a detail of the mould-die segment assembly for a first example of embodiment, in the box discharge position, wherein the die has moved with respect to the arm of the shaping unit.

In a first example of embodiment shown in FIGS. 5 to 7, the articulated lateral blades (12) are mounted on each one of the die segments (8*a*, 8*b*, 8*c*, 8*d*) by means of a guided support (35) that can be actuated by means of a guided cylinder (36) that linearly displaces the die segment (8*a*, 8*b*, 8*c*, 8*d*)-blade (12)-press (16) assembly to clear the box discharge path (10) in a direction parallel to the direction in which the cardboard sheets (2) are dispensed by the feeders, i.e. through the front part of the machine.

Figure 8:
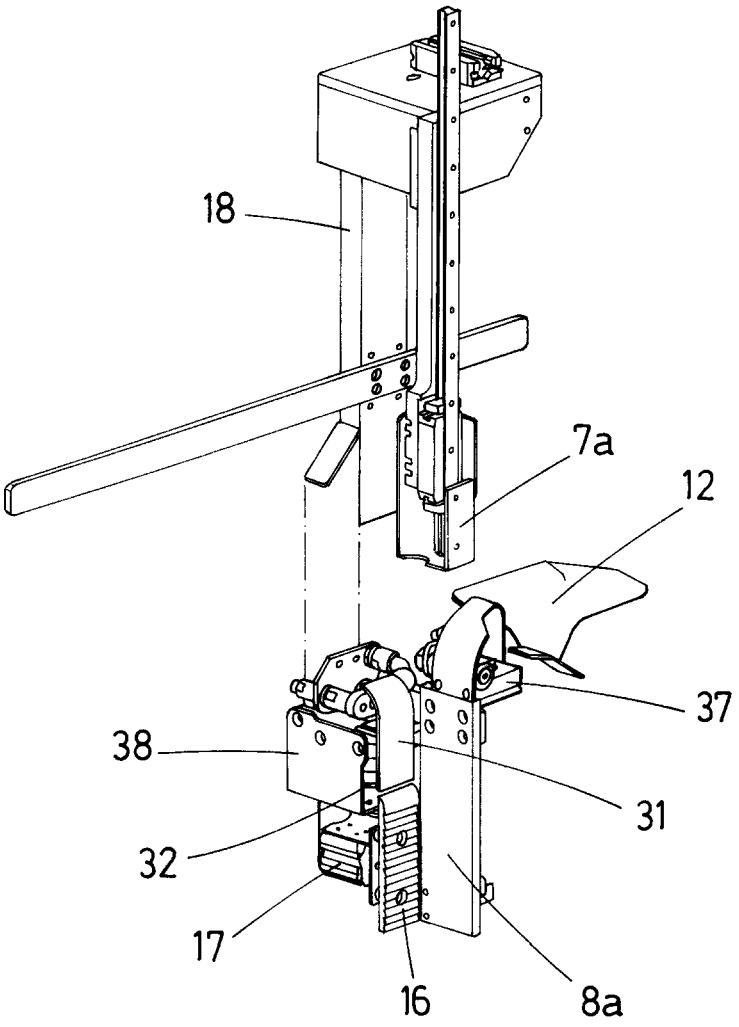
FIG. 8 shows a perspective view of a detail of the mould-die segment assembly for a second example of embodiment, in an open position, prior to the closed box forming position.

In a second example of embodiment shown in FIG. 8, the articulated lateral blades (12) are mounted on the chassis (11) by means of one of the four arms (18) of the shaping unit by means of an articulated support (37) which can be actuated by means of a rotating cylinder (38) that displaces the die segment (8*a*, 8*b*, 8*c*, 8*d*)-blade (12) assembly at an angle to clear the box (10) discharge path in a direction parallel to the direction in which the cardboard sheets (2) are dispensed by the feeders, i.e. through the front part of the machine.

Once the box has been discharged by the forming machine to first transfer means (40) for transferring the boxes (10) disposed at the front of the machine for the boxes discharged in a direction parallel to the direction in which the cardboard sheets are dispensed by the feeders, and to second transfer means (not shown) of the boxes (10) disposed on the side of the machine for the boxes discharged in a direction perpendicular to the direction in which the cardboard boxes are dispensed by the feeders, a new cycle for shaping other boxes (10) with the same characteristics would be initiated, until reaching a de-sired number of boxes (10).

Due to the fact that the transfer means have a maximum displacement speed that cannot be exceeded so that lightweight boxes (10) are not displaced or fall from the first or second transfer means, the presence of the first transfer means (40) and the second transfer means make it possible to increase the speed at which the formed boxes (10) are discharged from the machine without having to stop the heads until the box (10) has abandoned the front or side of the machine. Optionally, the first transfer means (40) deposit the formed boxes (10) on the second transfer means or vice versa.

When the packaging needs require another box (10) format, the parameters of the new box only need to be entered in the control panel, for the format changing mechanism of the shaping unit (6) to position the four inner mould segment (7*a*, 7*b*, 7*c*, 7*d*)-die segments (8*a*, 8*b*, 8*c*, 8*d*) assemblies at the points corresponding to the lower corners of the new box (10). Once the machine has been adjusted, the die-cut cardboard sheets (2) in the storage unit (1) are changed.

As can be observed in FIGS. 1 to 4, the format changing mechanism comprises four arms (18), on whose lower ends the die segments (8*a*, 8*b*, 8*c*, 8*d*) are mounted, with their respective lateral articulated blades (12) and lateral folding presses (16), whose arms (18) are hung by their upper ends from a set of transverse rails (19) assisted by motorised spindles (20), for the transverse displacement of the arms (18) and, therefore, from the die segments (8*a*, 8*b*, 8*c*, 8*d*).

The transverse rails (19) are mounted on a second set of longitudinal rails (21), solidly joined to the general chassis (11) of the machine, assisted by another pair of motorised spindles (22), for the longitudinal displacement of the arms (18) and, therefore, of the die segments (8*a*, 8*b*, 8*c*, 8*d*).

The motorised spindles (20, 22) comprise a threaded shaft (23) with two equal spiral portions in each direction, i.e. one left-hand threaded and another right-hand threaded, so that when the motor makes the spindle rotate, the respective mould-die segment assemblies move in the opposite direction, moving further apart or closer together. Therefore, by actuating the different motorised spindles (20, 22), we achieve the positioning of the four mould-die segment assemblies on each one of the lower corners of the box (10) for shaping thereof.

The four inner mould segments (7*a*, 7*b*, 7*c*, 7*d*) are mounted on the upper ends of the arms (18), through a guided rod (24), so that they move horizon-tally, accompanying their respective die segments (8*a*, 8*b*, 8*c*, 8*d*) in order to maintain a constant distance between the mould and the die.

As mentioned earlier, the inner mould composed of its four segments (7*a*, 7*b*, 7*c*, 7*d*) moves vertically and alternately inside the die composed of its four segments (8*a*, 8*b*, 8*c*, 8*d*) to shape the box (10). In the present example of embodiment, the actuation of the four segments (7*a*, 7*b*, 7*c*, 7*d*) that shape the inner mould is performed by means of an electric motor (26) and a rotating connecting rod-crank mechanism which transforms the rotational displacement into an alternate linear displacement. The connection of the end of the crank (26) to the guiding rods (24) of the inner mould segments (7*a*, 7*b*, 7*c*, 7*d*) for the transmission of the vertical and alternate displacement is performed through four articulated arms (27), connected by their outer end to the upper ends of the guided rods (24), and by their lower end on two slides (28) which slide along a transverse rail (29), connected to the lower end of the crank (26). The four arms (27) are articulated by means of vertical rotation axes to enable the horizontal displacement of the mould segments (7*a*, 7*b*, 7*c*, 7*d*). Therefore, when the format changing mechanism displaces the arms (18) to position them in the new format, the arms (27) will articulate and slide to adapt to the new configuration, without losing their connection to the connecting rod-crank mechanism (26).

The invention claimed is:

1. A multi-head multiformat box forming machine which comprises, at least:

one storage unit for die-cut cardboard sheets, two or more feeders wherein each one of said feeders dispenses the die-cut cardboard sheets unit by unit, means for guiding and positioning the die-cut sheets, means for supplying an adhesive substance on the die-cut cardboard sheet, two or more shaping units, each of which comprises at least one vertically displaceable inner mould and one outer die, and means for discharging the formed box being perpendicular to the feeders, wherein the mould and the die of each shaping unit are divided into four segments, respectively, which enable the horizontal displacement and positioning thereof at the points which coincide with the lower corners of the box when a format changing mechanism that comprises four arms displaces the four arms to position them in a new box format, wherein each one of the of mould-die segments and of each shaping unit moves solidly joined together so as to maintain the tolerances between the mould and the die;

wherein each shaping unit comprises actuation means for the vertical and alternate displacement of the four segments that shape the inner mould, and wherein the segments of the die of at least one of the shaping units are displaceable with respect to the arms of said shaping unit once the box has been formed, such as to clear a box discharge path in a direction parallel to the direction in which the cardboard sheets are dispensed by the feeders.

2. The machine of claim 1, wherein each one of the segments of the die of a shaping unit disposed on each of the sides of the machine are displaceable with respect to the arms of said shaping unit once the box has been formed, such as to clear the box discharge path in a direction perpendicular to the direction in which the cardboard sheets are dispensed by the feeders.

3. The machine of claim 1, wherein each one of the segments of each die comprises an articulated lateral blade which comprises actuation means for folding the inner flaps of the box.

4. The machine of claim 3, further comprising curved plates disposed on the sides of each one of the segments of the die, wherein each one of the curved plates is mounted on a platform, and joined to the sides of each one of the segments of the die, wherein the platforms also comprise a press with actuation means for folding and pressing the lateral flaps of the box.

5. The machine of claim 4, further comprising a chassis which comprises the four arms of the format changing mechanism for each shaping unit, on the lower ends of which the die segments are mounted, with their respective articulated lateral blades and presses.

6. The machine of claim 5 wherein the articulated lateral blades are mounted on each one of the die segments by means of a guided support that can be actuated by means of a guided cylinder that linearly displaces the die segment blade press assembly to clear the box discharge path.

7. The machine of claim 5 wherein the articulated lateral blades are mounted on the chassis by means of one of the four arms of the shaping unit by means of an articulated support which can be actuated by means of a rotating cylinder that displaces the die segment blade assembly at an angle to clear the box discharge path.

8. The machine of claim 5, wherein the arms are hung by their upper ends from a set of transverse rails assisted by motorised spindles for the transverse displacement of the arms and, therefore, of the die segments.

9. The machine of claim 8 wherein the transverse rails are mounted on a second set of longitudinal rails, solidly joined to the general chassis of the machine.

10. The machine of claim 9 wherein the motorised spindles comprise a threaded axis with two equivalent portions of spiral in each direction, i.e. one left-hand threaded and another right-hand threaded, such that when the motor makes the spindle rotate, the respective mould-die segment assemblies move in the opposite direction, moving further apart or closer together to position the four mould-die segment assemblies on each of the lower corners of the box for shaping thereof.

11. The machine of claim 10, wherein the four segments of the inner mould are mounted on the upper ends of the arms through a guided rod for the horizontal displacement thereof, accompanying their respective die segments in order to maintain a constant distance between the mould and the die.

12. The machine of claim 11, wherein the inner mould composed by its four segments moves vertically and alternately inside the die composed by its four segments to form the box.

13. The machine of claim 12, wherein the four segments that compose the inner mould are actuated by means of an electric motor and a connecting rod-crank mechanism that transforms the rotating movement into an alternate linear movement, wherein the connection of the end of the connecting rod to the guiding rods of the inner mould segments, for transmitting the vertical and alternate movement, is performed by means of four articulated arms connected by their upper end to the upper ends of the guided rods and by their inner end on two sliders that slide over a transverse rail connected to the lower end of the connecting rod.

14. The machine of claim 13, wherein the four arms are articulated by means of vertical rotation axes to enable the horizontal displacement of the mould segments, such that when the format change mechanism displaces the arms to position them in the new format, the arms are articulated and slide to adapt to the new configuration, without losing their connection to the connecting rod-crank mechanism.

15. The machine of claim 1, further comprising first transfer means disposed at the front of the machine for transferring the boxes discharged in a direction parallel to the direction in which the cardboard sheets are dispensed by the feeders, and, optionally, second transfer means disposed on at least one of the sides of the machine for transferring the boxes discharged in a direction perpendicular to the direction in which the cardboard sheets are dispensed by the feeders.

* * * * *